US005119606A

United States Patent [19]

Graham

[11] Patent Number: 5,119,606

[45] Date of Patent: Jun. 9, 1992

[54] INSULATED CONCRETE WALL PANEL

[76] Inventor: Tom S. Graham, 1226 E. 19th, Tulsa, Okla. 74120

[21] Appl. No.: 672,747

[22] Filed: Mar. 21, 1991

Related U.S. Application Data

[63] Continuation of Ser. No. 369,959, Jun. 22, 1989, abandoned.

[51] Int. Cl.[5] ..... E02D 35/00; E04C 1/00

[52] U.S. Cl. ..... 52/125.4; 52/309.11; 52/309.12; 52/600

[58] Field of Search ..... 52/405, 406, 309.11, 52/309.12, 600, 601, 125.4, 125.5

[56] References Cited

U.S. PATENT DOCUMENTS

| | | | |
|---|---|---|---|
| 2,652,713 | 9/1953 | Senglar | 72/16 |
| 3,295,278 | 1/1967 | Muhm | 52/309.12 X |
| 3,435,580 | 4/1969 | Merrill | 52/405 |
| 3,476,912 | 11/1969 | Garrison | 52/125.4 X |
| 3,512,327 | 5/1970 | Padura | 52/612 |
| 3,671,368 | 6/1972 | Shelley | 161/38 |
| 3,750,355 | 8/1973 | Blum | 52/309 |
| 3,760,540 | 9/1973 | Latoria et al. | 52/125 |
| 3,881,289 | 5/1975 | Mauroner | 52/405 X |
| 4,038,793 | 8/1977 | Roca | 52/125.4 |
| 4,087,947 | 5/1978 | Turner | 52/125.4 |
| 4,104,842 | 8/1978 | Rockstead | 52/650 |
| 4,164,831 | 8/1979 | Messick | 52/405 |
| 4,276,730 | 7/1981 | Lewis | 52/221 |
| 4,292,783 | 10/1981 | Mulvihill | 52/741 |
| 4,296,909 | 10/1981 | Haeussler | 52/125.4 X |
| 4,329,821 | 5/1982 | Long et al. | 52/405 X |
| 4,336,676 | 6/1982 | Artzer | 52/309.12 |
| 4,454,702 | 6/1984 | Bonilla-Lugo et al. | 52/309.12 X |
| 4,489,530 | 12/1984 | Chang | 52/309.12 X |
| 4,655,016 | 4/1987 | Jacob | 52/169.1 |
| 4,676,035 | 6/1987 | GangaRao | 52/125.5 |
| 4,702,053 | 10/1987 | Hibbard | 52/405 X |
| 4,718,210 | 1/1988 | McCourt | 52/309 |
| 4,785,602 | 11/1988 | Giurlani | 52/405 X |
| 4,942,702 | 7/1990 | Lemasson | 52/405 X |
| 4,974,381 | 12/1990 | Marks | 52/405 X |

FOREIGN PATENT DOCUMENTS

| | | | |
|---|---|---|---|
| 1001800 | 8/1965 | United Kingdom | 52/309.12 |

*Primary Examiner*—David A. Scherbel
*Assistant Examiner*—Lan Mai
*Attorney, Agent, or Firm*—Head & Johnson

[57] ABSTRACT

An insulated structural wall panel includes a monolithic concrete shell poured to conform to a structural reinforcing grid embedded in the shell with insulation panels fixed within the grid spaces. The layers of concrete which sandwich the insulation panels are rigidly tied together by use of tie rods extending through the insulation panel. This monolithic construction results in a lightweight panel with superior structural qualities, the concrete, the reinforcing grid and the insulation panels having been blended together into one homogeneous member. The panel may incorporate extraneous assemblies including doors, windows, vents, pipes, electrical junction boxes and the like. The reinforcing grid may also include various adaptive devices for suitable attachment of the concrete wall panel to concrete footings, floor slabs, roof members, temporary supports and the like.

14 Claims, 3 Drawing Sheets

INSULATED CONCRETE WALL PANEL

This is a continuation of copending application Ser. No. 07/369,959 filed on Jun. 22, 1989, now abandoned.

BACKGROUND OF THE INVENTION

This invention relates to structural wall systems employed in the construction of commercial and industrial buildings and more particularly concerns wall panels constructed of concrete and incorporating insulating materials in the panel.

The basic principle of incorporating an insulating material between two layers of concrete is not unique to the construction industry. However, efforts to utilize this principle in a practical wall system with sufficient flexibility to encompass a wide range of commercial and industrial applications have met with limited success. The insulated concrete wall panel systems currently marketed are generally inadequate due to deficient insulating properties, excessive bulk and weight characteristics, structural complexity or a combination of these design inadequacies.

They consist basically of two structurally independent concrete panels with a layer of insulation material between them in order to achieve both structural and insulation properties. In this arrangement, the addition of a second layer of concrete, insulation material, steel reinforcing materials and the connectors necessary for lamination to the primary layer of concrete produce a heavy and difficult to handle panel. Panels of this type often weigh in excess of 100 pounds per square foot of panel area. The mechanical connection of two heavy, independent concrete panels with an insulation layer between them presents structural problems which are difficult to overcome. Furthermore, the insulation thickness which can be incorporated between the concrete layers without compounding the structural problems is limited.

Other disadvantages result because the insulation material in these systems generally covers the entire area of the "primary" panel, leaving the edges of the insulation material exposed in the finished product. This allows penetration of moisture between the two layers of concrete causing corrosion in the laminating tie system, decay of the insulation material, loss of insulation properties and eventual structural problems.

A variation of this multi-panel, laminate design substitutes a concrete "grid" or "waffle" pattern slab on top of a self-sufficient primary panel with insulation panels occurring within the concrete grid. This variation eliminates the problem of exposed insulation edges and structural bonding problems between the separate concrete panels, but the overall panel weight is extremely high. Therefore, as with the previously described panel configuration, this inefficient design results in high cost and a cumbersome product to handle, transport and erect.

Despite the fact that these panels are heavy and cumbersome, the normal procedure is to construct them in an off-site facility and then transport them to the job-site for erection. They could be constructed on-site but additional problems of control are added to those of design, resulting in a finished product of haphazard quality and undependable structural capability. Furthermore, the entire building project is delayed until all the wall panels have been formed and poured on the building floor slab and allowed to "cure" for a period of perhaps ten to twenty days. This period of project "shutdown" during fabrication of the wall panels can consume from six weeks to three months, depending upon the scope of the project.

In another variation directed at these on-site problems, wall panels utilizing the laminate principle have been constructed on the job-site in a vertical position directly over the footing system. But this requires highly labor intensive form systems and an on-site assembled steel reinforcing structure. Of all presently used insulated wall systems, this is the most labor intensive, time consuming and expensive. Walls of this type are "custom built" without any of the benefits of production techniques and systems. It is also difficult to place concrete into the formed wall system without dislodging the insulation material occurring at the central point of the wall.

It is therefore an object of this invention to provide a versatile concrete wall panel system utilizing the composite-laminate principle that is capable of supporting structural loads commonly encountered in commercial and industrial buildings, but which can be readily produced in volume at a competitive cost. Another object of this invention is to combine both structural and insulating functions in a single, monolithic system without duplication of function. Similarly, it is an object of this invention to completely surround the insulation components in the reinforced monolithic, concrete body of the panel, providing both the structural requirements and protective facing for the insulation material in a strong, lightweight product.

SUMMARY OF THE INVENTION

In accordance with the invention, an insulated structural wall panel and a method for constructing it are provided. The panel consists of a monolithic concrete shell poured to conform to a structural reinforcing grid embedded in the panel with insulation panels fixed within the grid spaces, the layers of concrete which sandwich the insulation panels being rigidly tied together by use of tie rods extending through the insulation panel. Use of this monolithic construction results in a lightweight panel with superior structural qualities, the concrete, the reinforcing grid and the insulation panels having been blended together into one homogeneous member. The panel may incorporate extraneous assemblies including doors, windows, vents, pipes, electrical junction boxes and the like. The reinforcing grid may also include various adaptive devices for suitable attachment of the concrete wall panel to concrete footings, floor slabs, roof members, temporary supports and the like.

BRIEF DESCRIPTION OF THE DRAWINGS

Other objects and advantages of the invention will become apparent from reading the following detailed description and upon reference to the drawings in which.

DETAILED DESCRIPTION

Figure 1:
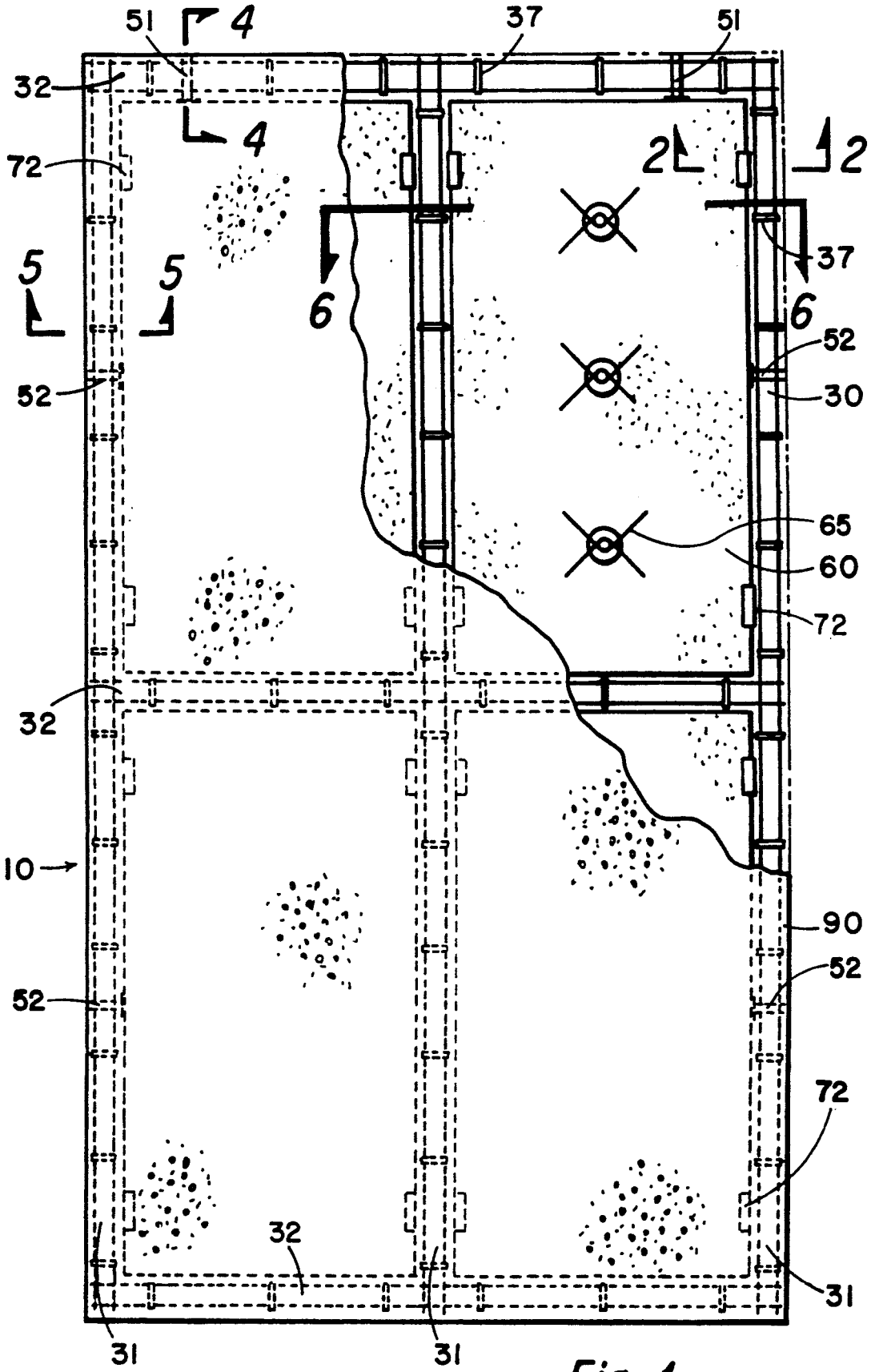
FIG. 1 is a plan with parts broken away illustrating the reinforcing grid and the insulation panel in the concrete panel.

Turning to the figures, a wall panel 10 is illustrated which consists of a structural reinforcing grid 30 framing in a number of insulation panel assemblies 60, all surrounded by a monolithic concrete casing 90.

The grid 30 is typically made using welded steel construction methods and consists of conventional steel reinforcing bars of a weldable type held in place by specialized bar ties. In the preferred embodiment shown in FIGS. 1 and 2, the reinforcing grid 30 uses at least two vertical members 31 and at least three horizontal members 32 which are generally equally spaced apart. The vertical members 31 are typically not more than five feet on center and the horizontal members 32 typically not more than eight feet on center, but this can vary depending on the panel load requirements or as inclusion in the reinforcing grid 30 of extraneous assemblies such as doors, windows, vents and the like (not shown) may dictate. As best seen in FIG. 2, each of the vertical 31 and horizontal members 32 consists of four steel rods 33 and 34 and 35 and 36 welded in a rectangular and parallel spaced apart relationship to several bar ties or rectangular steel straps 37. The reinforcing rods 33, 34, 35 and 36 are of the weldable type and in a deformed configuration. The straps 37 are typically constructed of 3/16 inch by ½ inch weldable steel bars and spaced approximately 16 to 24 inches on center, although specific applications may result in variations of these dimensions. In addition to being welded to the straps 37, every upper face vertical rod 33 is welded to every upper face horizontal rod 35 and every lower face vertical rod 34 is welded to every lower face horizontal rod 36. Thus, all joints between the bar ties 37 and the reinforcing rods 33, 34, 35 and 36 and between intersecting rods 33 and 35 or 34 and 36 are welded together to form a rigid, monolithic, reinforcing system which can be incorporated into the concrete panel as a single component. This interlocking by welding provides a resultant reinforcing grid that displays a rigidity and stability not normally associated with other structures used to reinforce concrete panels. Furthermore, the welded reinforcing grid makes possible a highly efficient panel system by allowing the engineer greater degrees of control over grid member location and resultant panel weight.

Support members, such as machined steel rods 38, are also welded to the lower faces 39 of the steel straps 37 so as to position the grid 30 at the proper elevation within the panel forming system (not shown) as is hereinafter explained.

Figure 3:
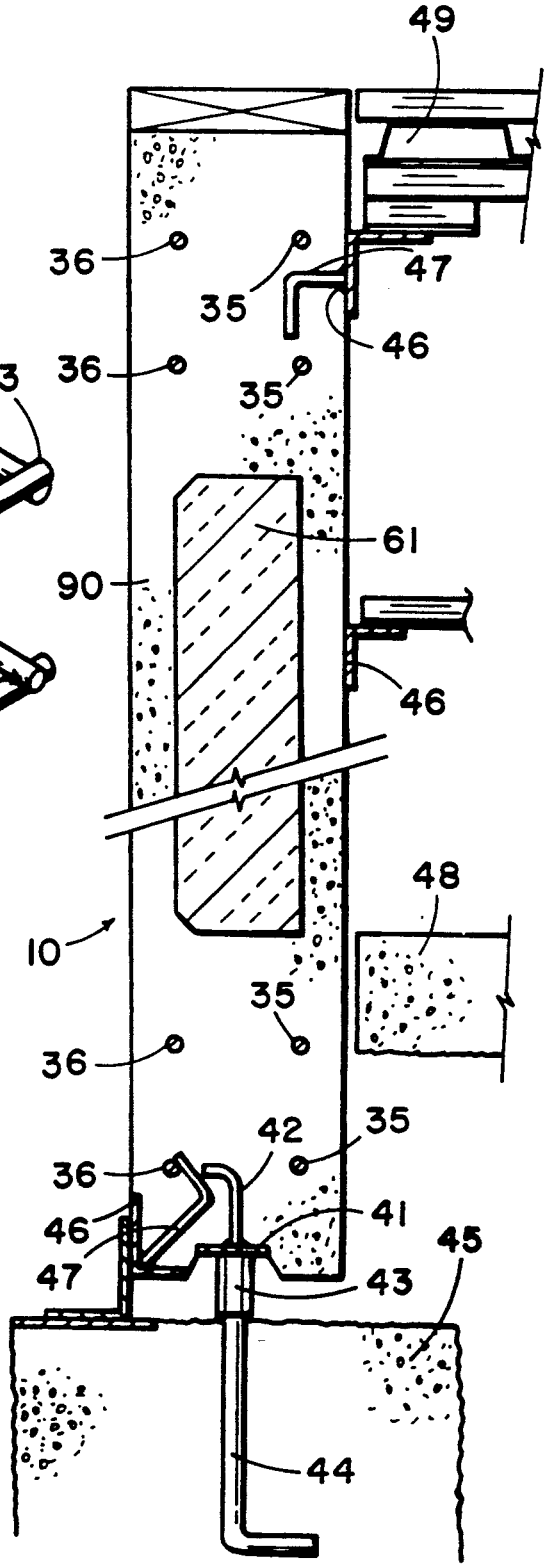
FIG. 3 is a cross section illustrating typical adaptive devices embedded or mounted in the upper or lower portions of the concrete panel in its mounted position in a building structure for connecting the building structure and the wall panel.

Various adaptive devices for connection of the concrete panel 10 to a building structure may also be embedded in the concrete panel 10 as shown in FIG. 3. Steel bearing plates 41 attached to a welded steel anchor 42 are embedded in the concrete along the bottom surface of the concrete panel 10. When the concrete panel 10 is in the mounted position, the bearing plates 41 would each rest on a level adjuster such as a nut 43 threadedly mounted on a bolt 44 anchored in the concrete footing 45. Steel angle irons 46, or other suitable steel members, attached to a steel anchor 47 may also be embedded or mounted on the surface along the top or bottom portion of the concrete panel to provide means for connecting the concrete panel 10 with the building footing 45, floor slab 48, roof structure 49, or the like.

Depending on the requirements of any particular project, additional adaptive members may be embedded in the concrete panel with connecting steel anchor rods as necessary. All of these adaptive devices may be held in place for embedding in the concrete by welding the anchors to the grid 30 or by detachably connecting the anchors or the devices to the forms in which the panel is constructed.

Figure 4:
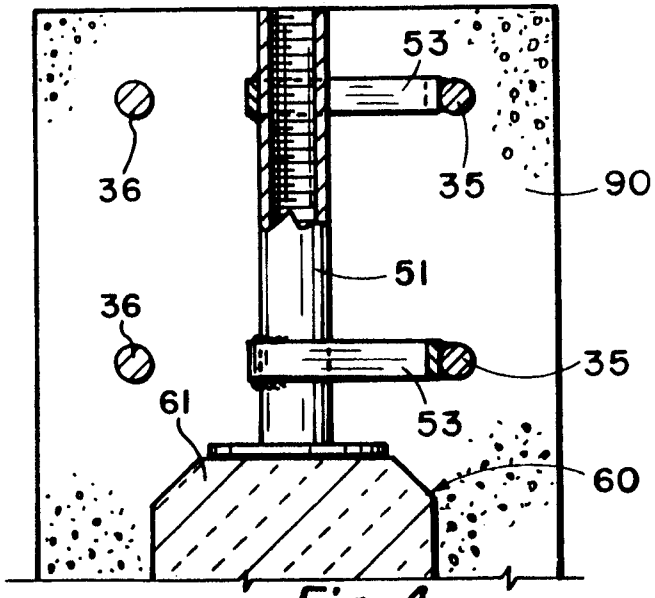
FIG. 4 is an enlarged cross section taken along line 4—4 of FIG. 1 illustrating the lift sleeves of the concrete wall panel.

Top and side lift sleeves 51 and 52 may also be provided for handling the completed concrete panel 10, the former for handling the concrete panel 10 in a vertical position and the latter for handling it in a horizontal position. The top lift sleeves 51 may, for example, be internally threaded steel sleeves, as shown in FIG. 4, fixed to anchors 53 embedded in the concrete. The sleeves 51 are spaced apart in the top surface of the concrete panel 10 with the threaded portion being accessible from the top of the concrete panel 10. The side lift sleeves 52 consist of two pairs of sleeves, not necessarily threaded, each pair being disposed on opposite sides of the concrete panel 10 with the sleeves 52 being accessible from the side of the concrete panel 10. The sleeves 52 are spaced apart in the sides of the concrete panel 10 such that the weight of the concrete panel 10 will be substantially evenly distributed during lift in the horizontal position. The sleeves 52 may be mounted in the concrete panel 10 by use of anchor rods embedded in the concrete 90 or welded to the grid 30.

Figure 5:
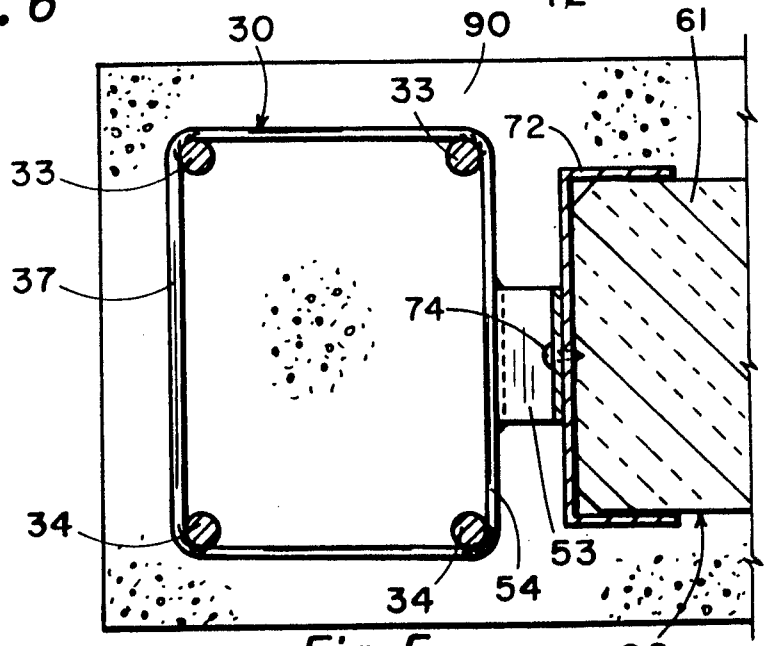
FIG. 5 is an enlarged cross section taken along line 5—5 of FIG. 1 illustrating the connection of the insulation panel to the reinforcing grid.

As shown in FIG. 5, the grid 30 can also include provisions for the connection of the insulation panel assemblies 60 to the grid 30, perhaps by use of brackets 53, one welded to the interior faces 54 of several of the straps 37. The connection of the insulation panel assemblies 60 to the brackets 53 will be hereinafter explained.

Figure 2:
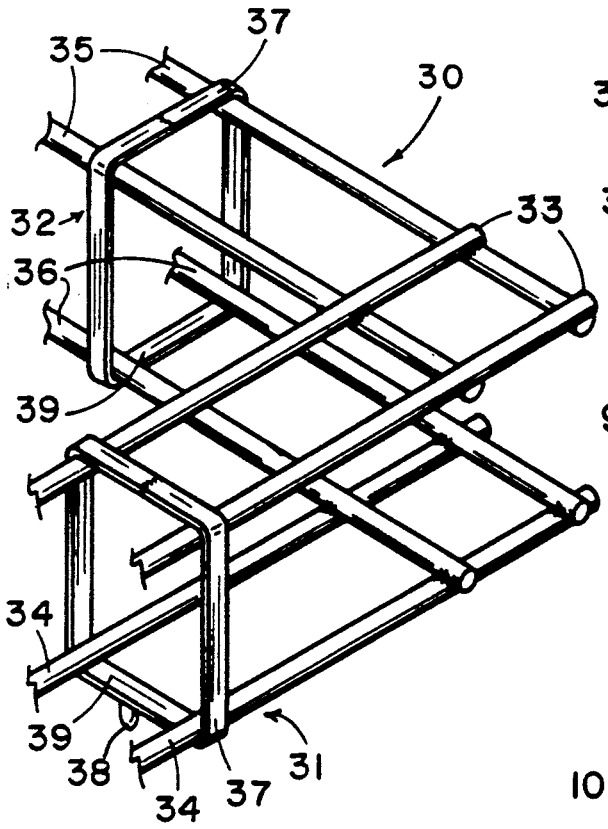
FIG. 2 is a perspective view taken at line 2—2 in FIG. 1 illustrating the assembly of the reinforcing grid.
Figure 6:
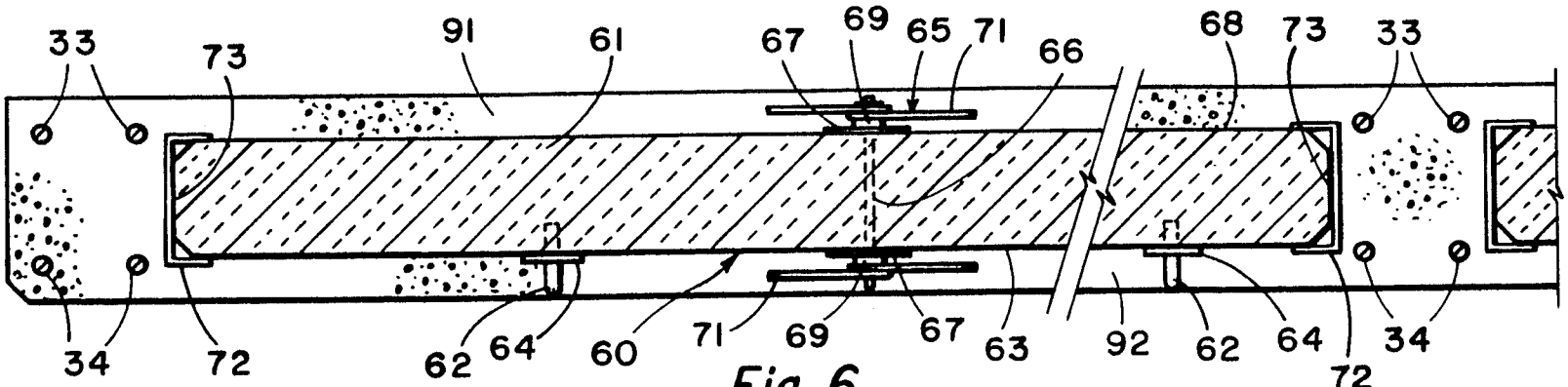
FIG. 6 is an enlarged cross section taken along line 6—6 of FIG. 1 illustrating the insulation panel assembly within the poured concrete panel.

Looking now to FIGS. 1, 5 and 6, the insulation panel assembly 60 incorporates an insulation panel 61 selected according to the specific insulating, fire resistance and weight characteristics required of the concrete panel 10. Any material of sufficient rigidity and stiffness to withstand the stresses of assembly and production may be used including foamed plastics, fiberglass, rock wool, mineral wool, foam glass, insulating concretes and numerous other alternatives. Depending on the characteristics of the chosen insulating panels 61, several insulation supports 62, perhaps machined or diecast plastic, may be pushed into the lower face 63 of the insulation panel 61. The length of the supports 62 is such that the insulation panel 62 will be properly positioned at a preselected level above the bed (not shown) on which the concrete panel 10 will be formed, usually at a height of at least one inch and typically one and one-half inches. The supports 62 may include a steel or plastic washer 64 at the insulation panel lower surface 63 to distribute the pressure on the panel face and prevent damage during the construction process.

Also preassembled in the insulation assembly 60 are steel ties 65 that will interlock the opposite layers 91 and 92 of concrete between which the insulation panel 61 will ultimately be sandwiched. The ties 65 typically consist of a steel shaft 66 threaded on both ends and extending through the insulation panel 61. Steel or plastic washers 67 overlay the upper 68 and lower 63 faces of the insulation panels 61 to prevent penetration of the insulation panels 61 by the ties 65 during the construction process. Threaded sleeves 69 applied at either end of the shaft 66 secure the shaft 66 in place and steel bars 71 are welded to the sleeves 69 so as to be disposed within the concrete layers 91 and 92 poured on either side of the insulation panel 61. Finally, U-shaped channels 72 are fitted onto the side edges 73 of the insulation panel 61 for eventual attachment to the grid brackets 53, perhaps by use of self-tapping screws (not shown) The channels 72 may be fastened to the insulation panels by use of self-threading screws 74 as shown in FIG. 5.

In constructing the monolithic concrete insulated structural wall panel 10, a horizontal form bed (not shown), typically of steel construction, supports a steel perimeter form bolted to it (not shown). The form bed is generally equipped with conventional apparatus (not shown) for heating the concrete panel in order to closely control the temperature of the concrete during its initial curing process. The bed may be lined to create a selected surface finish on the concrete panel 10. The surfaces of the bed and perimeter forms are prepared to receive the concrete by spraying them with a "bond release" material to assure that the concrete will not adhere to the surfaces of the bed and forms. Extraneous assemblies such as doors, windows, vents, piping, junction boxes and the like are then placed within the frame and secured by use of appropriate anchors (not shown). Concrete is prepared as necessary for the particular project involved. Typically, the mixture would be for a lightweight, early strength, low slump, low water/cement ratio concrete with desired insulating properties. The mixture may incorporate plasticizers, expanded shale or similar lightweight aggregates, high strength cements, fumed silica, insulating aggregates such as perlite, fiber reinforcing and the like.

The concrete is poured into the form so as to achieve a first layer 92 of concrete of predetermined thickness. Typically, this would be a 1 178 inch thick layer of concrete. This first layer 92 of concrete is then leveled to an accurate and uniform thickness. The leveling is aided by the mechanical vibration of the concrete material to provide a regular, evenly distributed, unbroken, uniform surface to the concrete, free from voids and other irregularities.

With the first layer 92 of concrete thus poured, the preassembled steel reinforcing grid 30 and insulating panel assembies 60 are inserted together as a single component into the appropriate position within the form and on or into the leveled first layer 92 of concrete. The supports 38 and 62 mounted on the lower faces 39 and 63 of the rectangular straps 37 and the insulation panels 61 support the grid 30 at the proper level in the concrete panel 10. The desired adaptive devices will, of course, already have been secured in the form or to the grid 30 as hereinbefore explained. The reinforcing grid 30 and the insulating assembly 60 will have been preassembled prior to placement in the form by cutting the insulation panels 61 to the desired size to fit within the spaces formed by the vertical and horizontal members 31 and 32, mounting the concrete ties 65, the channels 72 and the insulation supports 62, if any, on the insulation panels 61 and attaching these insulation panel assemblies 60 to the grid 30 by securing the channels 72 to the brackets 53.

With the preassembled reinforcing grid 30 and insulating assemblies 60 so placed, additional concrete is poured to fill the form and encase the reinforcing grid 30 and the insulation assemblies 60 under a second layer of concrete 91. This is generally accomplished by filling the voids within the preassembled reinforcing grid 30 and insulating assemblies 60 to be sure that no voids or gaps are left and then continuing the pouring until the form is full. During the pouring process the concrete is mechanically vibrated to assure its uniform distribution throughout the form. The additional concrete must be poured within a time interval such that a cold joint will not occur between the first 92 and second 93 layers of concrete.

When the pouring is complete the surface of the second layer 93 of concrete is leveled and the leveled surface allowed to attain an initial set. When the leveled surface is initially set a selected finish may then be applied to the surface. The finished panel 10 is then heat cured at a preselected and controlled temperature, typically for a period of twenty-four hours. When the curing cycle is complete, the forms and heat curing apparatus are disassembled and the completed concrete panel 10 lifted from the form bed using the side lift sleeves 52. The concrete panel 10 may be removed to a storage area where it will generally remain in the horizontal position until time for use. The concrete panels 10 can be stacked in the horizontal position with wood spacers between them to allow air circulation and continued curing at ambient temperature until transportation to the job site. Alternatively, the concrete panel 10 can be finished by adding a selected coating material to the surface of the concrete panel 10 after curing is complete.

Many variations are of course possible. Insulating panel thickness can be varied to achieve the desired panel insulation properties. The concrete panels may be virtually any height or width and with varying structural capabilities. This can be accomplished by varying the size of the reinforcing bars or the thickness of the concrete panels or by use of additional steel reinforcing bars or any combination of these and other variations. The steel rods 33, 34, 35 and 36 may be fixed to truss bars or various combinations of tie arrangements other than bar ties or rectangular straps. Structural reinforcing mats or bars may be embedded in the concrete panel layers 92 and 93. The variety of finishes which can be applied to either face of the panel is also virtually unlimited and may include exposed aggregate finishes, smooth formed faces, formed embossed finishes, hand broomed or raked finishes, impressed finishes, tile or brick, stucco plaster, polymer concrete grout and any of numerous other variations of these specific finishes.

Furthermore, while the concrete panel has been described in relation to a welded steel embodiment, the principles involved may equally well apply to the use of fiberglass or other structural materials chemically mastecized or glued together, or to angle iron, I-bar, trusses or other types of reinforcing members and it is also contemplated that the description applicable to wall panels includes roof panels as well.

Thus, while the invention has been described in connection with a preferred embodiment and procedure, it will be understood that it is not intended to limit the invention to that embodiment or procedure. On the contrary, it is intended to cover all alternatives, modifications and equivalents as may be included within the spirit and scope of the invention as defined by the appended claims.

What is claimed is:

1. An insulated structural wall panel comprising:

a casing of monolithic concrete;

a structural reinforcing grid fully embedded within the monolithic concrete of said casing, said grid consisting of at least two vertical members fixedly intersecting at least three horizontal members;

a plurality of insulation panels fully embedded within the monolithic concrete of said casing, one in said panel in each space formed by said intersecting members of said grid with said members surrounding the edges of each of said insulation panels; and rigid tie means extending through each of said insulation panels and embedded in the layers of said monolithic concrete sandwiching said insulation panels.

2. An insulated structural wall panel comprising:

a casing of monolithic concrete;

a structural reinforcing grid fully embedded within the monolithic concrete of said casing, said grid consisting of at least two vertical members approximately equally spaced apart and at least three horizontal members approximately equally spaced apart, each of said members consisting of a plurality of rods and means fixing said rods in parallel spaced apart relationship, every vertical rod being fixed to at least one rod of each of said horizontal members and every horizontal rod being fixed to at least one rod of each of said vertical members;

a plurality of insulation panels fully embedded within the monolithic concrete of said casing, one in each space formed by said vertical and horizontal members of said grid with said members surrounding the edges of each of said insulation panels; and rigid tie means extending through each of said insulation panels and having ends embedded in the layers of said monolithic concrete casing sandwiching said insulation panels.

3. An insulated structural wall panel comprising:

a rectangular casing of monolithic concrete;

a structural reinforcing grid orthogonally fully embedded within the monolithic concrete of said casing, said grid consisting of at least two vertical members approximately equally spaced apart and at least three horizontal members approximately equally spaced apart, each of said members consisting of at least four rods and means for fixing said rods in a parallel rectangular configuration, every vertical rod being fixed to two rods of each of said horizontal members and every horizontal rod being fixed to two rods of each of said vertical members;

a plurality of insulation panels also fully embedded within the monolithic concrete of said casing, one in each space formed by said vertical and horizontal members of said grid with said member surrounding the edges of each of said insulation panels; and rigid tie means extending through each of said insulation panels and having ends embedded in the layers of monolithic concrete casing sandwiching said insulation panels.

4. A panel according to claims 1, 2 or 3 further comprising at least one pair of sleeves, one sleeve embedded in said monolithic concrete of each of the opposite sides of said panel, each of said sleeves having an opening accessible through its respective side edge of said panel.

5. A panel according to claims 1, 2 or 3 further comprising a pair of inwardly threaded sleeves embedded in said monolithic concrete in spaced apart relationship in the top of said panel, each of said sleeves having its threaded opening accessible through the top edge of said panel.

6. A panel according to claims 1, 2 or 3 further comprising means for fastening said insulation panels to said grid.

7. A panel according to claims 1, 2 or 3 further comprising means embedded in and extending from said monolithic concrete casing for attachment to exterior braces.

8. A panel according to claims 1, 2 or 3 further comprising means fixed to said grid for positioning said grid within said panel.

9. A panel according to claims 1, 2 or 3 wherein the members of said structural reinforcing grid are formed of weldable steel and all fixed joints of and between said members are formed by welding.

10. A panel according to claims 1, 2 or 3 said tie means comprising a plurality of anchor assemblies, each of said assemblies consisting of a shaft extending through an insulation panel and threadedly connected at each end to an anchor embedded in said monolithic concrete of said casing.

11. A panel according to claims 1, 2 or 3 further comprising at least two bearing plates embedded in said monolithic concrete and disposed along the bottom edge of said panel, each of said plates being fixed to an anchor embedded in said monolithic concrete of said casing.

12. A panel according to claims 1, 2 or 3 further comprising means embedded in or disposed on said monolithic concrete and fixed to an anchor embedded in said monolithic concrete for interconnecting said panel and a building structure.

13. A panel according to claims 1, 2 or 3 wherein at least one inch of monolithic concrete surrounds said structural reinforcing grid.

14. A panel according to claims 1, 2 or 3 wherein the ultimate cured weight of said monolithic concrete is in the range of from 85 to 115 pounds per cubic foot.

* * * * *